United States Patent [19]

Kitamura et al.

[11] 4,446,881

[45] May 8, 1984

[54] METHOD FOR PRESSURE TRANSPORT OF METHANOL THROUGH A PIPELINE

[75] Inventors: Yasuo Kitamura, Chiba; Masao Suzuki, Tokyo; Toshio Kubota, Ebina; Hiroshi Watanabe, Zushi; Masaaki Tsujimoto, Funabashi, all of Japan

[73] Assignee: Toyo Engineering Corporation, Tokyo, Japan

[21] Appl. No.: 409,470

[22] Filed: Aug. 19, 1982

[30] Foreign Application Priority Data

Aug. 28, 1981 [JP] Japan ..... 56-134198

[51] Int. Cl.[3] ..... C23F 15/00

[52] U.S. Cl. ..... 137/1; 422/7; 422/12

[58] Field of Search ..... 48/190; 137/1; 422/7, 422/10, 13, 14, 12; 44/53, 54

[56] References Cited

U.S. PATENT DOCUMENTS 4,018,703 3/1977 Turner ..... 422/12 X 4,344,861 8/1982 Levy ..... 422/12 X

*Primary Examiner*—Alan Cohan

*Attorney, Agent, or Firm*—Flynn, Thiel, Boutell & Tanis

[57] ABSTRACT

A method for the long-distance transport of a liquid of methanol or a solution of methanol and at least one organic compound other than methanol, under pressure, through a pipeline installation in which the portions of the pipeline installation that contact said liquid consist essentially of carbon steel and/or low alloy steel, the sum of whose metallic components other than Fe is up to 5 wt. %, in which the water content of said liquid is limited to (a) the range of 0 to 35 wt. % if the content of the formate radical in said liquid is up to 0.05 wt. %, (b) the range of 0.25 to 35 wt. % if the content of the formate radical in said liquid is in the range of 0.05 to 2 wt. % and (c) the range of 0 to 35 wt. % if the content of the formate radical in said liquid is in the range of 2 to 3 wt. %, so that said liquid is transported under pressure while the volume ratio of the formate radical to the water content is kept at a ratio that does not permit the presence of more than 3 wt. % of the formate radical in the liquid.

6 Claims, 10 Drawing Figures

METHOD FOR PRESSURE TRANSPORT OF METHANOL THROUGH A PIPELINE

FIELD OF THE INVENTION

The present invention relates to a method for the long-distance transportation of liquid methanol or a methanol-containing solution, under pressure, through a pipeline, at a temperature close to ambient temperature, which prevents corrosion of the components of the pipeline by formate (HCOO—) radicals and water that are present in the methanol and which make it possible to make the pipeline itself and the pressure elevating device or devices interposed in the pipeline from plain carbon steel or low alloy steel.

Large quantities of energy resources are now transported from the sites of the natural deposits thereof to the sites of consumption thereof because of the increase in energy consumption. Such energy resources include hydrocarbon gas, petroleum-type crude oil, coal, and the like. In recent years, much importance has been placed on the use of methanol as a material to be mass-transported in order to use it as an energy source at a site of consumption, in the same way as the above-mentioned natural energy resources. Among the hydrocarbon gases, petroleum crude oil, heavy oil adhering to oil sand and coal that have been exploited, hydrocarbon gas and ordinary petroleum crude oil can be easily pressure-transported overland through a pipeline either to the site of consumption or to a port for shipment by marine transportation using tankers. In the case of some heavy crude oils or heavy oils adhering to oil sand, however, heating must be effected while they are being pressure-transported through a pipeline because they have a high viscosity and a high melting point. Because it is solid, coal is not suitable for the pressure-transport through a pipeline. On the other hand, an installation for mass producing methanol can be established at the site of exploitation of those natural energy resources which cannot easily be pressure-transported through a pipeline. Accordingly, the natural energy resources which are not suitable for pressure-transport through a pipeline can be transformed into methanol and the methanol can be pressure-transported through a pipeline to the site of consumption.

BRIEF DESCRIPTION OF THE DRAWINGS

Long-distance pressure-transport through a pipeline of large quantities of fluids, regardless of their kind, is generally effected in accordance with the basic method illustrated in FIG. 1, as is well known in the art. In FIG. 1, symbol A represents the site of shipment of the fluid and B is the destination. The line connecting A and B represents the pipeline installation and the symbols $P_1$, $P_2$, $P_3$, . . . $P_n$ on that line represent relay pump stations for elevating the pressure of the fluid. At the site of shipment A, the pressure of the fluid is elevated to 10 kg/cm$^2$G to 190 kg/cm$^2$G by a compressor or a pump and the fluid is fed under that pressure into the pipeline. During the travel of the fluid to the destination B, the pressure of the fluid gradually decreases inside the pipeline due to the pressure loss during its flow. Accordingly, a first relay pump station $P_1$ equipped with a compressor or pump (both will be called "pump" hereinafter) and a power source for driving the pump is disposed at point $P_1$, which is located an appropriate distance from the site of shipment A, so that the pressure of the fluid is again raised to 10 to 190 kg/cm$^2$G and the fluid is caused to flow in the direction of the destination B. The pressure of the fluid, again drops during its continued travel, and it is again raised by similar equipment at point $P_2$ and the fluid is caused to flow towards a third relay pump station $P_3$. These procedures are repeated until the fluid reaches the final destination B. The distances between the site of shipment A and the first relay pump station $P_1$ and between the following relay pump stations vary with the viscosity of the fluid, the velocity of the fluid inside the pipeline, the pressure head between the site of shipment A and the first relay pump station, the pressure heads between the following relay pump stations, and so forth. However, the distance between relay pump stations generally is in the range of from 50 to 200 km and the distance between the site of shipment A and the destination B is sometimes as long as tens of hundreds of kilometers.

Figure 1:
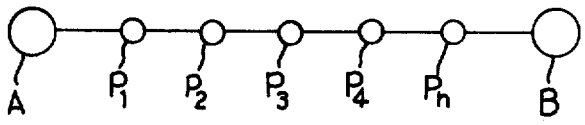
FIG. 1 diagrammatically illustrates the concept of a pipeline installation.

Generally, sufficient facilities for workers are provided at both the site of shipment A and the destination B, but since each relay pump station P is set up along a road or a railway where the workers cannot easily be stationed, the installation at the relay pump station is preferably simple and its operation is controllable from a remote location.

In a pipeline installation of the kind described above, a power source for driving the pressure-elevating pump at each relay pump station is of the utmost importance. If the fluid that is being pressure-transported through the pipeline cannot be used as the fuel for generating the power, an electric transmission line or another pipeline for the fuel must be provided, thus additionally increasing the cost of installation of the pipeline.

In the pressure-transport of hydrocarbon gas, the hydrocarbon gas which is being pressure-transported can be easily used as the fuel at the relay pump station. The power is generated by a gas turbine using a part of this gas as the fuel and the power from the gas turbine is used for driving the compressor or the like. In the case of petroleum crude oil, however, it is difficult to use unrefined crude oil as a fuel for the gas turbine and hence, another power source or another fuel must be used.

On the other hand, the optimum material to be used for making the pipeline itself and for the installation at each relay pump station, such as the pressure-elevating device and the piping arrangement, is plain carbon steel or conventional low alloy steel, the sum of whose metallic components, other than Fe, is up to 5 wt. %, from the aspect of its cost. High grade steel, such as stainless steel, is too expensive to be used as a pipeline material to transport a relatively economical material, such as fuel.

In pressure-transporting naturally occurring petroleum crude oil and hydrocarbon gas through a pipeline, both of them are hydrocarbons that do not exhibit significant corrosion to carbon steel or low alloy steel at a temperature close to ambient temperature. For this reason, such pipeline installations have been made of carbon steel or low alloy steel. Furthermore, if the fluid is a liquid, the pumps used at the site of shipment, each relay pump station and the destination are generally multi-stage centrifugal pumps because they are suitable for elevating the pressure of large quantities of the fluid to a high pressure.

The present invention relates to a method for the pressure transport of a liquid containing methanol through a pipeline. Methanol can be generally used as a fuel for a gas turbine and it is believed to exhibit no corrosion to plain carbon steel and low alloy steel. However, the inventors of the present invention have discovered that methanol causes stress corrosion cracking of both plain carbon steel and low alloy steel and would cause vigorous stress corrosion cracking or corrosion fatigue of important equipment, such as the piping arrangement and the multi-stage pumps, if methanol is transported through a pipeline installation which is subjected to high pressure or to high tensile stress.

It is known in the art that tensile stress exists in various machines and piping arrangements made of metals during operation or shutdown. For example, large tensile stresses remain at the weld portions of pipes connected to each other by welding and on the inner surface of the pipes in the proximity of the joint in both the longitudinal and circumferential directions of the pipes. This tensile stress is further increased when an internal pressure is applied to the pipes. Tensile stress also exists on the vane impeller of a centrifugal pump during its rotation, the tensile stress resulting from the centrifugal force and the reaction of the force applied to the liquid. Furthermore, residual tensile stress is present, resulting from the shrinkage fit that exists near the inner circumference of the vane impeller where it is fixed to a rotary shaft by a shrink fit. On the other hand, if carbon steel or low alloy steel is kept in constant contact with a material which is corrosive, even if only slightly corrosive, in the presence of tensile stress, the stress and corrosion cooperate with each other to cause cracking which proceeds along the crystal grain faces of the metal or which crosses the crystal grains and eventually results in breakage. This phenomenon is known as stress corrosion cracking. If repetitive pulsation exists in the magnitude of the tensile stress in this case, the phenomenon occurring thereby is known as corrosion fatigue. (Hereinafter, both phenomenona will be referred to as "stress corrosion cracking".)

In pressure-transporting a solution containing methanol through a pipeline, the existence of stress corrosion cracking of plain carbon steel and low alloy steel is a fatal problem for the piping arrangement and multi-stage centrifugal pumps used under a high-pressure condition. This phenomenon is not observed in the case of the pressure transport of hydrocarbons through a pipeline, indicating that the pipeline pressure transport of methanol is remarkably different from that of hydrocarbons.

The inventors of the present invention have carried out intensive studies on the stress corrosion cracking of plain carbon steel and low alloy steel caused by methanol and have confirmed that stress corrosion cracking is caused primarily by a small or trace amount of formic acid that is present in or is formed in methanol, as will be described hereinafter. The inventors have also found that even if a considerable amount of formic acid is contained in the methanol, if proper precautions are taken stress corrosion cracking does not occur and ordinary corrosion is slight. The contents of these findings will be illustrated in the examples given below, but they can be summarized as follows. If the formic acid content in methanol is from zero up to 0.005 wt. %, stress corrosion cracking does not occur within the range of a water content of from zero to 35 wt. %. In this case, the methanol-containing solution can be pressure-transported. If the formic acid content is from 0.005 to 0.05 wt. %, stress corrosion cracking will occur, if stress concentration exists, within the range of the water content of from zero to 35 wt. % in methanol, but it does not occur if stress concentration does not exist. Hence, the methanol-containing solution can be pressure-transported, provided that measures for preventing the tensile stress concentration are taken in the design and production of the equipment and piping arrangement. If the formic acid content is from 0.05 to 2.0 wt. %, vigorous stress corrosion cracking occurs within the range of a water content of up to 0.25 wt. % in methanol and pressure transport is not feasible in this case. However, if the water content is from 0.25 wt. % to 35 wt. %, stress corrosion cracking does not occur and pressure transport becomes possible. If the formic acid content is within the range of 2 to 3 wt. %, stress corrosion cracking does not occur within the range of a water content of zero to 35 wt. % and pressure transport is possible, although slight ordinary corrosion is observed. If the formic acid content exceeds 3 wt. %, ordinary corrosion becomes so vigorous that pressure transport is no longer possible.

The present invention is based on the above-mentioned findings concerning the corrosion and stress corrosion cracking phenomenona. The finding that there is a range in which pipeline pressure transport is possible, and a range in which it is not possible, depending on the formic acid and water contents in the methanol, suggests that methanol intended for mass transport for use as a fuel for generating energy can be pressure-transported in the form of highly purified methanol after formic acid, water and other by-produced organic compounds in the methanol are removed and that, so long as the formic acid and water contents in methanol fall within the above-mentioned pressure-transportable range, in accordance with a more simplified production method of methanol, methanol can also be pressure-transported as a solution in which the by-products of methanol production and other organic matters are dissolved in methanol.

It has been a customary practice to add an alkali, such as caustic soda, to methanol so as to neutralize the formic acid therein and to mitigate the corrosion otherwise caused by formic acid. However, if methanol containing caustic soda is used as a fuel for a gas turbine, vigorous corrosion would occur on the fuel chamber and vane impeller of the gas turbine. The ammonia neutralization method that has also been used for the same purpose does not cause severe problems, such as in the case of caustic soda and, hence, methanol containing ammonia can be used as a fuel. However, since the solubility of ammonium formate varies depending on the composition of organic by-products and their amounts in the mixture, crystals are likely to separate. Further, when the fuel is burnt, nitrogen oxide gases would be generated. For these reasons, it is not preferred to neutralize formic acid by adding large quantities of ammonia. If the formic acid content is within the above-mentioned range, these problem do not occur, even if formic acid is neutralized by ammonia, but the ammonium formate dissociates in the presence of water, forming formic acid and resulting eventually in stress corrosion cracking in the same way as described above.

It is, therefore, to be noted that the term "formic acid" used in this specification refers to formate radicals (HCOO—) in formic acid, ammonium formate and formic acid esters which generate formic acid upon hydrolysis that will be described hereinbelow.

To sum up the above-mentioned facts, in pressure-transporting methanol or a methanol-containing solution through a pipeline, the present invention adjusts and maintains the contents of the formate radical and water in ranges in which vigorous stress corrosion cracking or remarkable corrosion of the ordinary type does not develop, so that plain carbon steel or low alloy steel can be used as the constructional materials for making those portions of the pipeline installation, such as the piping arrangement, pumps and the like, which come into contact with methanol or the methanol-containing solution. At the same time, the present invention makes use of the fact that the presence of a considerable amount of water is permitted within the range in which stress corrosion cracking or vigorous corrosion to the pipeline components does not occur, so that a major energy saving can be attained in purifying the methanol. The present invention is further intended to make possible the pressure transport of organic by-products formed in the methanol production and other utilizable organic compounds, such as hydrocarbons, together with methanol, and to improve the energy resource pressure-transport capacity of the pipeline made of ordinary materials while using methanol or the methanol-containing solution as the fuel for operating the gas turbines disposed at the relay pump stations.

Hereinafter, the present invention will be described in further detail. In the description which follows, the range of amounts of formate radicals and water which makes the pipeline pressure transport possible without causing the above-mentioned corrosion and stress corrosion cracking will be referred to as the "pressure-transportable range" and the range that causes corrosion and stress corrosion cracking and is not used in practice, will be referred to as the "pressure-untransportable range", respectively.

Incidentally, these ranges are common to both plain carbon steel and low alloy steel. As regards the formic acid, the amount contained in the methanol fed into the pipeline as well as the amount which is formed afresh during the pipeline pressure transport must be taken into consideration.

As is well known, methanol is produced by bringing a mixed gas consisting principally of hydrogen, carbon monoxide, carbon dioxide and the like into contact with a catalyst layer, at high temperature, at a pressure ranging from 40 to 300 kg/cm$^2$, in accordance with the following main reactions (1) and (2):

$$2H_2+CO \rightarrow CH_3OH \quad (1)$$

$$3H_2+CO_2 \rightarrow CH_3OH+H_2O \quad (2)$$

It is known that ethers such as dimethyl ether, diethyl ether, or isopropyl ether, aldehydes such as acetaldehyde or propionaldehyde, esters such as methyl formate, methyl acetate, or methyl propionate, hydrocarbons such as n-pentane, n-hexane, n-heptane, or n-octane, ketones such as acetone, methyl ethyl ketone, or methyl isopropyl ketone, monohydric alcohols such as ethanol, n-propanol, tert-butanol, isobutanol, or n-butanol, and other organic compounds are formed simultaneously with the main reactions (1) and (2), although the types of the by-product compounds formed will vary depending on the reaction conditions and the properties of the catalyst used. It is also known that the content of these by-products is up to 15 wt. %, based on the methanol. Hereinafter, the term "%" means percentage by weight. Recently, catalysts are also known which catalyze the formation of these by-products in quantities exceeding the quantity of methanol.

Accordingly, a crude methanol solution obtained by condensing the gas leaving the catalyst layer after the reaction, by cooling or washing the gas with a small amount of water, contains a large amount of organic by-products besides methanol and water which are produced as principal reaction products of reactions (1) and (2). Although it varies with the ratio of carbon monoxide and carbon dioxide in the starting gas, the content of water in the crude methanol is from 3 to 35 wt. % as is obvious from reactions (1) and (2). Purified methanol used for conventional industrial purposes is obtained by removing substantially all the water and organic by-products by subjecting the crude methanol to first and second, and sometimes third, rectifying steps. As another method of producing methanol, a hydrocarbon-rich gas, such as methane, is oxidized, at high temperature, in the presence of a catalyst, to form methanol. However, a large number of organic by-products are formed in addition to methanol in the same way as in the above-mentioned methods.

Formic acid is present in crude and purified methanol produced in the above-mentioned manner and mainly causes the aforementioned stress corrosion cracking phenomenon. Although the reason why formic acid is present in both kinds of methanol and why formic acid is formed in them is not known, it may be presumed to be substantially as follows. First, oxidation upon contact of methanol with air, expressed by the following reaction (3) may be pointed out:

$$2CH_3OH+O_2 \rightarrow 2HCHO+2H_2O$$

$$2HCHO+O_2 \rightarrow 2HCOOH \quad (3)$$

As the second factor, hydrolysis of methyl formate, as one of the above-mentioned organic by-products, may be pointed out:

$$HCOOCH_3+H_2O \rightarrow HCOOH+CH_3OH \quad (4)$$

A third possible factor is a so-called Cannizzaro reaction (5), due to the presence of formaldehyde as an intermediate product in the reaction (3):

$$2HCHO+H_2O \rightarrow CH_3OH+HCOOH \quad (5)$$

Among these three kinds of formic acid forming reactions, the starting compound, that is, methyl formate, is the by-product of the methanol-forming reaction. Hence, if it is sufficiently removed during the purification of crude methanol, it is not formed afresh inside the pipeline. However, if the removal is not sufficient and the compound is pressure-fed into the pipeline, hydrolysis of methyl format gradually proceeds at a temperature near ambient temperature and results in the formation of formic acid inside the pipeline. The reactions (3) and (5) are oxidations of methanol by air and the formation of formic acid can be prevented if measures are taken so as to prevent the methanol-containing solution from coming into contact with oxygen.

In the pressure-transport of methanol produced in the aforementioned manner as the fuel for energy generation by use of a pipeline installation whose portions in contact with methanol consist principally of carbon steel or low alloy steel, the present invention is directed to the fundamental feature that the relation between the content of the formate radical and the water content is adjusted or purified in order to accomplish and maintain the aforementioned pressuretransportable range and after this adjustment or purification is effected, the relation between the content of the formate radical and the water content is kept within the pressure-transportable range lest methanol should come into contact with air to increase the amount of formic acid so that the relation of the content of the formate radical and the water content should become out of the pressure-transportable range. In accordance with the method of the present invention, it is now feasible to pressure-transport methanol through a pipeline over a distance of as long as 1,000 km or more without causing severe problems, such as corrosion and stress corrosion cracking, on the portions of the pipeline installation in contact with the methanol that is being pressure-transported and which is made principally of plain carbon steel or low alloy steel, and wherein multistage centrifugal pumps for effecting the pressure elevation are driven by using some of the methanol that is being pressure-transported, as a fuel at the relay pump stations.

From the aspect of the content of the invention, there are a variety of embodiments of the present invention. In accordance with the first embodiment of the method, after the pressure of purified methanol obtained in the conventional methanol production method is elevated using a multi-stage centrifugal pump, it is pressure-fed into the pipeline and is pressuretransported to the next relay pump station or to the destination while being prevented from coming into contact with air except for that portion thereof which is used as the fuel for the gas turbine at each relay pump station and while its pressure is being elevated by the gas turbine.

The contents of formic acid and water are up to 0.002% and up to 0.1%, respectively, in the purified methanol immediately after purification, in accordance with the conventional production methods of methanol, although the values may differ somewhat from method to method. Hence, these values fall within the aforementioned pressure-transportable range and the solution does not become pressure-untransportable unless the solution comes into contact with air during the pressure-transportation in the pipeline so as to increase the content of the formate radical. Incidentally, the amount of methanol used as the fuel at the relay pump stations is about 1.5% based on the weight of purified methanol to be pressure-transported per 1,000 km, although this amount varies to some extent depending on the quantity that is pressure-transported and the efficiency of the gas turbine and centrifugal pump. (Low grade calorific powder is $5.04\times10^6$ kcal per ton of purified methanol.) However, this first embodiment is not the preferred embodiment of the present invention for the following reasons.

First, this embodiment does not utilize the organic by-products of the methanol production, other than the above-mentioned formic acid and methyl formate. Second, a great deal of energy (approximately 1,000,000 kcal per ton of purified methanol) is consumed to remove these organic by-products and water to a high degree. When methanol is mainly burnt so as to generate energy, as in the present invention, it is not necessary to remove the organic by-products other than formic acid and methyl formate and water to such a high degree as is done for obtaining conventional purified methanol for industrial purposes. In other words, there is no problem even if the organic by-products, other than formic acid and methyl formate, are contained in methanol that is to be pressure-transported. On the contrary, since most of these organic by-products are substances having higher calorific values than methanol, it is preferred that they be contained in the methanol that is to be burnt. This will result in a reduction of the energy required for the methanol production and in an improvement in the efficiency of the fuel utilization at each relay pump station. These effects are further enhanced in the case of methanol production methods in which the proportion of the organic by-products is greater.

Similarly, it is not necessary to reduce the water content of the methanol to be pressure-transported down to 0.1% or below, as is done in purified methanol for industrial purposes. The water content of crude methanol varies remarkably depending on the kind and temperature of use of the catalyst used for the methanol production, the pressure, the gas composition and the like, as described above. In most cases, however, the water content is from 4 to 20%. If the content of the formate radical alone is adjusted to the range of 0.05 to 0.5% by a method of simple distillation, by alkali addition or an ion-exchange method, the aforementioned pressure-transportable range can be attained and crude methanol purified to a moderate extent can be pressure-transported through the pipeline. In this case, the energy consumption for partially purifying the crude methanol can be reduced to a value of up to 20% of the energy required for obtaining conventional purified methanol. If the total length of the pipeline is small, the number of relay pump stations is fewer and the increase in the power necessary for the pressure transport is relatively small even if the diameter of the piping arrangement must be considerably increased in order to pressuretransport the water. Even if methanol comes into contact with air so as to considerably increase the amount of formic acid in the methanol, at a reduced number of relay pump stations, a solution containing methanol, organic by-products and water (hereinafter referred to as the "methanol-containing solution") can be practically pressure-transported to the destination while keeping the content of the formate radical within the pressure-transportable range. Since it is possible to bring methanol into contact with air at the relay pump stations, the installation for handling the methanol-containing solution inside the relay pump stations can also be simplified.

However, if the overall length of the pipeline is great and the number of relay pump stations is therefore great, remarkable increases in all of the components of the pressure transport installation become necessary, such as increases in the materials of the piping arrangements, in the number of multistage centrifugal pumps having large pressure-elevating capacity, in the energy required for the pressuretransport and the like, when a methanol-containing solution having the water content of 5% or more is to be transported. In this case, the second embodiment of the invention, which reduces the water content, becomes especially effective. In the second embodiment, the water content in the methanol-containing solution is adjusted preferably to 0.25 to 5% and most preferably, to 0.25 to 0.5%, and the content of the formate in the methanol-containing solution is adjusted to 0.1% or below, for example.

In a methanol production method using a gas having a low carbon dioxide content as the starting gas, the water content in the resulting crude methanol is about 4 to about 7%. The energy required for purifying crude methanol having such a water content to obtain partially purified methanol having a water content of about 0.25 to about 0.5% is less than 60% of the energy required for purifying crude methanol to purified methanol having a water content of up to 0.1%. Hence, the energy for the purification can be reduced remarkably. The content of the formate radical in crude methanol varies remarkably depending on the method used for the methanol production, especially on the catalyst used. However, in order to reduce the content of formic acid radical down to 0.05 to 0.1%, the purification is remarkably easier than is the case of achieving the purification of crude methanol down to 0.002% or below. If the water content of the methanol-containing solution is from about 0.25 to about 0.5%, the adverse influences on the required diameter of the piping arrangement, the heat efficiency of the gas turbines and the transportation capacity of the multi-stage centrifugal pumps can be substantially neglected. If the water content is within this range, the relation between the water content and the content of the formate radical will never be out of the aforementioned pressure-transportable range even if the methanol-containing solution must be brought into contact with air at the relay pump stations and the content of the formate radical increases.

Another important advantage brought forth by this second embodiment is that considerable quantities of gaseous or liquid hydrocarbons can be dissolved in the methanol-containing solution having the water content of about 0.25 to about 0.5%. The larger the amount of organic by-products produced in the methanol production, the greater is the quantity of the hydrocarbons that can be dissolved therein. The table below sets forth the quantity (cubic meters) of each hydrocarbon shown in the left column that can be dissolved, per ton of each liquid shown in the top column, at 0° C. and 1 atm.

| hydrocarbon and its pressure | liquid | pure methanol | methanol 99 wt. % water 1 wt. % | methanol 70 wt. % n-butanol 30 wt. % | methanol 69.3 wt. % n-butanol 29.7 wt. % water 1 wt. % |
|---|---|---|---|---|---|
| methane | 25 atm. | 15.0 | 14.9 | 21.0 | 20.8 |
| ethane | 1 atm. | 2.8 | 2.8 | 4.3 | 4.3 |
| propane | 1 atm. | 6.8 | 6.7 | 11.0 | 10.9 |
| n-butane | 1 atm. | 23.7 | 23.5 | 44.8 | 44.3 |

These hydrocarbons do not cause any corrosion or stress corrosion cracking of the pipeline installation made of carbon steel or low alloy steel, as described previously. This fact makes it possible, as an application of the present method, to dissolve those hydrocarbons, which are available at the site of shipment A and are either gaseous or liquid at normal temperature, in the methanol-containing solution at a preferred pressure, either during the pressure elevation of the methanol-containing solution or before the subsequent pressure-feeding of the solution into the pipeline, and to pressure-transport them together with methanol and the organic by-products. The hydrocarbons which can be utilized in such a case are natural gases, natural gases occurring from coal mining and the residual gas that cannot be converted into methanol, even after repeated contact with the catalyst during production of methanol (the gas withdrawn from the pipe 9-1 in FIG. 2 below). The hydrocarbons can also be obtained by subjecting a gas containing large quantities of hydrogen and carbon monoxide to the following reactions (6) or (7):

$$3H_2+CO \rightarrow CH_4+H_2O \quad (6)$$

$$(2n+1)H_2+nCO \rightarrow C_nH_{2n+2}+nH_2O \quad (7)$$

where n is generally a positive integer of 2 to 40.

The reaction (6) is known as a so-called methanization reaction, while the reaction (7) is known as a so-called Fischer-Tropsch synthesis of hydrocarbons. They are vigorous exothermic reactions using a catalyst, at normal or elevated pressure. Production of methanol is carried out with the aforementioned reaction (1) as the main reaction wherein the ratios of hydrogen and carbon oxides employed are in excess of the theoretical ratios expressed by reactions (1) and (2) and, hence, the residual gas that has been purified is advantageous for carrying out the reactions (6) and (7). Since these reactions are strongly exothermic and proceed more vigorously under higher pressure, they can be easily practiced in the same way as in the production of methanol described below by feeding the residual gas from the methanol production into a reactor packed with a suitable catalyst, which reactor can control suitably the catalyst temperature, at substantially the same pressure as that of the methanol production, while the heat energy is being recovered. Next, the gas leaving the reactor is cooled and after the condensate is separated, the gas is brought into contact with methanol or the methanol-containing solution at high pressure, whereby the hydrocarbons obtained in accordance with reactions (6) and (7) can be easily dissolved in the methanol-containing solution.

If the hydrocarbon to be dissolved is a natural gas, it can be easily dissolved in methanol or the methanol-containing solution by first compressing the gas and then bringing it into contact with methanol or the methanol-containing solution. It is obviously possible to dissolve the hydrocarbons into the liquid to be pressure-transported, even if the liquid is purified methanol. For the above-mentioned reasons, the term "methanol-containing solution" used herein can be defined not only as being a solution in which water and the organic by-products of the methanol production are dissolved, but also as being a solution in which the hydrocarbons are additionally dissolved, whenever desired. If the hydrocarbons are additionally dissolved in methanol or in the methanol-containing solution and then pressure-transported through the pipeline, the hydrocarbons can be used as the fuel at each relay pump station and the methanol that would otherwise be used as the fuel at each relay pump station can be saved. Thus, the ratio of the energy consumed at the site of shipment A to the energy received at the destination B can be improved.

In the present invention, it is possible to use the known method in order to remove the formate radical and water from crude methanol, as exemplified by ordinary rectification for removing water from crude methanol. The formate radical can be removed from crude methanol in accordance with the following simple method. An aqueous alkali solution, such as caustic soda, is fed to a crude methanol feed stage or higher stage of a rectifying column used for removing the water in the above-mentioned method so as to convert formic acid contained in the crude methanol into sodium formate and simultaneously to hydrolyze methyl formate into methanol and sodium formate. Both kinds of sodium formate are then discharged as an aqueous solution from the lower part of the rectifying column. However, the situations are somewhat different in this method of crude methanol purification between the production of purified methanol and the production of the less pure methanol-containing solution.

Figure 2:
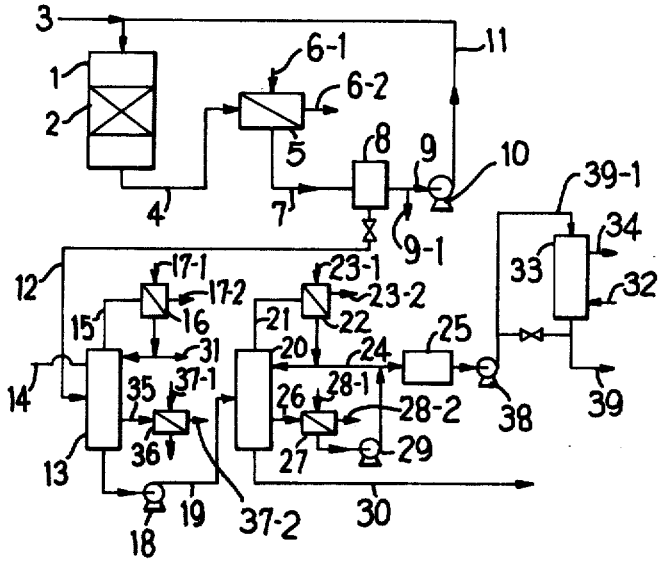
FIG. 2 illustrates an example of a method for removing the formate radical from crude methanol at the site of shipment.

First, the conventional method of rectifying crude methanol to obtain purified methanol will be described in conjunction with the method of removing the formate radical with reference to FIG. 2. In the drawing, reference numeral 1 represents a methanol synthesizing reactor which is operated at an internal pressure of 40 to 300 kg/cm$^2$ and reference numeral 2 represents a catalyst for the methanol synthesis and which is placed inside the synthesizing reactor. The catalyst is kept at a temperature of 250° to 450° C. A high pressure gas, which consists principally of hydrogen, carbon monoxide and carbon dioxide and is supplied from a fresh starting gas feed port 3, is caused to flow through the catalyst layer 2 kept at a high temperature, whereby the known methanol synthesis reaction occurs in accordance with the known reactions (1) and (2) and a part of the gas is converted into gaseous methanol. The gas leaving the catalyst layer 2 flows through a pipe 4 and is indirectly cooled by a coolant which is fed by a cooler 5 through a pipe 6-1 and is discharged from a pipe 6-2, so that methanol, water and the organic by-products are condensed. The condensate and uncondensed gas are sent to a separator 8 through a pipe 7. The gas flows through a pipe 9 and its pressure is elevated by a gas circulating apparatus 10. Thereafter, the gas is fed through a pipe 11 and joins fresh starting gas supplied from the pipe 3 and is circulated again to the methanol synthesizing reactor 1.

During this circulation, a part of the gas is withdrawn as residual gas from the pipe 9-1. This residual gas can be used in the hydrocarbon production steps (not shown in the drawing) in accordance with reactions (6) or (7), whenever necessary. On the other hand, the pressure of the condensate separated from the gas by the separator 8 is reduced to a desired level and the gas dissolved in the solution is separated (not shown in FIG. 2). Crude methanol, after removal of this dissolved gas, is the aforementioned crude methanol which comprises a large number of organic by-products besides methanol and water. The water content and the kind and content of the organic by-products differ remarkably depending on the composition of the gas passing through the catalyst layer 2, the pressure, the kind and temperature of the catalyst, and so forth. Crude methanol flows through the pipe 12, is supplied to the feed stage at the intermediate portion of a first rectifying column 13 in accordance with the content of components having a boiling point lower than that of crude methanol and is simultaneously subjected to the so-called extractive distillation operation, together with the water containing caustic soda or the water containing methanol and caustic soda that is supplied from the pipe 14 to a desired stage above the crude methanol feed stage of the rectifying column 13.

As a result of this extractive distillation, the organic by-products having a boiling point lower than that of methanol are withdrawn as the vapor through a pipe 15 at the top of the rectifying column 13, and are indirectly cooled in the cooler 16 by the coolant supplied from the pipe 17-1 and discharged from the pipe 17-2, so that the lower boiling organic by-products are condensed and liquefied. A part of the condensate is fed back to the upper part of the first rectifying column 13 as reflux. The remaining condensate, other than that which is fed back to the first rectifying column as the reflux, is withdrawn through a pipe 31 and is burnt or treated by other means as waste in the conventional methanol purification process. As described already, formic acid and methyl formate contained in the crude methanol are converted into sodium formate and methanol by the neutralization reaction and by the hydrolysis reaction and neutralization reaction in accordance with the aforementioned reaction (4) while rectification is being carried out inside the first rectifying column 13.

On the other hand, methanol, water and those organic by-products which have higher boiling points than that of methanol can be obtained as bottoms from the lower part of the first rectifying column 13 and these bottoms also contain sodium formate and excess caustic soda.

The first bottoms withdrawn from the lower part of the first rectifying column 13 are fed by the pump 18 through a pipe 19 to the feed stage at the intermediate portion of a second rectifying column 20 in accordance with the composition of the first bottoms and are subjected to rectification. Highly pure methanol vapor is flowed from the upper part of the second rectifying column through a pipe 21 into a second cooler 22 and is indirectly cooled and condensed by the coolant supplied from the pipe 23-1 and discharged from the pipe 23-2. A part of the condensate is fed back as reflux to the upper part of the second rectifying column 20 while the rest of the condensate is flowed through a pipe 24 and is stored as purified methanol in a tank 25.

A side stream, which is a second vapor, is withdrawn through a pipe 26 from a desired stage between the feed stage and the lowermost stage of the second rectifying column 20 and is cooled and condensed by the coolant fed to a side stream cooler 27 through a pipe 28-1 and discharged from a pipe 28-2. This side stream generally consists of 33 to 43% of methanol, 10 to 15% of organic by-products having boiling points between that of methanol and that of water and those organic by-products whose boiling points themselves are higher than that of water but which form, together with water, an azeotropic mixture whose boiling point is lower than that of water (e.g. butanols), and the balance of water. The side stream is treated as an unwanted material if the object is to obtain purified methanol. A solution consisting of up to 2% by by-products having boiling points higher than that of methanol, sodium formate and excess caustic soda and the balance of water is withdrawn through a pipe 30 as the second.bottoms from the lower part of the second rectifying column 20. The second bottoms are discharged as waste or are used for suitable applications.

Purified methanol stored in the tank 25 generally has a content of the formate radical of up to 0.05% and a water content of up to 0.1% and these values are within the aforementioned pressure-transportable range. Hence, it can be pressure-fed into the pipeline 39 and pressure-transported to the destination B by the multistage centrifugal pump 38 by use of appliances, not in contact with an oxygen-containing gas, disposed at the pipe 24 and the tank 25 or downstream of them. If necessary, purified methanol can be introduced into a gas-liquid contact apparatus 33 through a pipe 39-1 before it is fed to the pressure-transport system where the pressure of methanol is elevated. In the gas-liquid contact apparatus 33, the methanol is brought into contact with the gas containing the aforementioned gaseous hydrocarbons or the gas containing liquid and gaseous hydrocarbons (e.g. gas obtained by subjecting the residual gas withdrawn from the pipe 9-1 to the reaction (7) and then cooling it) so as to dissolve the hydrocarbons in the methanol and the solution can be then pressure-fed into the pipeline 39. Generally, the rectification process in the embodiment shown in FIG. 2 is mostly carried out at a pressure ranging from atmospheric pressure to 10 $kg/cm^2$. In the pipeline pressure-transport as in the present invention, however, a high pressure can be employed.

However, the rectification process can be simplified and the energy necessary for rectification can be saved in the following manner, if the methanol-containing solution to be pressure-transported through pipeline is a mixture of methanol and the organic by-products. Various simplified rectifications are also possible depending on the composition of crude methanol. The principle of simplification will be described with reference to the embodiment shown in FIG. 2. If the object is to obtain the methanol-containing solution (not substantially pure methanol), no problems occur, in particular, even if a large quantity of methanol is contained in the vapor obtained from the upper pipe 15 of the first rectifying column 13, so long as the contents of the formate radical and water are within the aforementioned pressure-transportable range. The content of the formate radical in the stream obtained from the overhead of the column 13 can be adjusted to the pressure-transportable range by feeding water containing caustic soda from the pipe 14 to a desired stage between the feed stage and the overhead. Accordingly, the overhead fraction obtained from the pipe 31 can be pressure-fed into the pipeline through the tank 25 if the design is modified in accordance with the known design method so that the condensate of the vapor obtained from the overhead through the pipe 15 contains 0.25 to 0.5 wt. % of water, methanol and organic by-products having a lower boiling point than that of methanol and the first bottoms consisting essentially of sodium formate, excess caustic soda and the balance of water is obtained from the bottom.

In this case, those organic by-products whose boiling points are between that of water and that of methanol and those organic by-products whose boiling point is higher than that of water but whose azeotropic mixture with water has a lower boiling point than that of water, are withdrawn mostly from a desired stage between the feed stage and the bottom of the first rectifying column 13 through a side stream withdrawing pipe 35 together with considerable amounts of water, as a vapor, in the same way as the lower side stream 26 of the second rectifying column 20 and they can be cooled and condensed by the coolant supplied by the cooler 36 from the pipe 37-1 and discharged from the pipe 37-2. If the quantities of the organic by-products having a boiling point between that of water and that of methanol and organic by-products whose boiling point is higher than that of water but whose azeotropic mixture with water has a boiling point lower than that of water are small, the solution obtained as the lower side stream 35 of the first column 13 can be fed directly to the tank 25 and then pressure-fed into the pipeline together with the solution obtained from the upper part of the first rectifying column 13 through the pipe 31 in the same way as in the pressure-feed of purified methanol described already.

This method can completely eliminate the second rectifying column and can remarkably reduce the energy required for rectification. In accordance with this method, however, the loss of organic by-products becomes great if large quantities of the organic by-products having a higher boiling point than methanol are contained in the crude methanol. To reduce this loss, the design of the first rectifying column is changed so that the organic by-products having a higher boiling point than methanol can be obtained as the bottoms of said first column together with sodium formate, excess caustic soda and water and fed to the second rectifying column. The design of the second rectifying column 20 is changed so that the organic by-products having a boiling point between that of methanol and that of water and organic by-products whose boiling point is higher than that of water but whose azeotropic mixture with water has a lower boiling point than that of water, are distilled together with considerable amounts of water. Sodium formate, excess caustic soda, an extremely small amount of water and those organic by-products whose boiling point is higher than that of water but whose azeotropic mixture with water has a boiling point lower than that of water can be obtained as the bottoms of the second rectifying column 20.

In this case, the overhead distillate of the first rectifying column obtained from the pipe 31 and the overhead distillate of the second rectifying column obtained from the pipe 24 are together sent to the tank 25 and are pressure-fed into the pipeline 39 by use of the multistage centrifugal pump 38. The distillate can be naturally brought into contact with the hydrocarbon-containing gas in the gas-liquid contact apparatus 33 so as to pressure-feed and pressure-transport the hydrocarbons dissolved therein into the pipeline 39 in exactly the same way as in the pressure transport of purified methanol.

If the above-mentioned rectifying steps are employed, a methanol-containing solution containing a small amount of water can be obtained and the energy for rectification can be remarkably reduced in comparison with the pressure-transport of purified methanol through the pipeline. These rectifying steps can be practiced at from normal (atmospheric) pressure to a pressure of about 10 $kg/cm^2$ in the same way as in the case of purified methanol, but since it is not necessary to reduce the water content to an extremely low level, unlike the case of purified methanol, they can be carried out at a higher pressure than in the case of purified methanol.

The multi-stage centrifugal pump 38 at the site of shipment A need not be driven by a gas turbine using methanol or the methanol-containing solution as the fuel, in particular, but it can be driven by various known driving methods.

Next, the method of elevating the pressure of the solution at each relay pump station will be described. As described already, formic acid is generated when methanol or the methanol-containing solution (both will be hereinafter referred to as the "liquid composition") comes into contact with air at the relay pump station. In accordance with the method of the present invention, the liquid composition can contain formic acid to a certain extent. Accordingly, even after formic acid is generated by contact of the liquid composition with air at the relay pump station, the liquid composition can be pressure-transported without any problem if the relation of the content of the formate radical and the water content of the liquid composition is within the aforementioned pressure-transportable range. If the contact of the liquid composition with air is permissible at the relay pump station, the present invention can be performed by a known simple method, such as one involving the steps of storing the liquid composition pressure-transported from the site of shipment A or from the upstream relay pump station in a tank permitting free flow of air, and then elevating the pressure of the solution and pressure-feeding it into the pipeline using the multi-stage centrifugal pump, for example. From the practical point of view, it is, however, too complicated to control, from a remote place, the quantity of formic acid formed by contact of the liquid composition with air at each of a large number of relay pump stations so as to maintain the liquid composition within the pressure-transportable range. It is preferred that the contact of the liquid composition with air at each relay pump station be minimized. Accordingly, in the following explanation of the installation of each relay pump station or the like, there will be described, by way of example, embodiments in which measures are taken so as to avoid as much as possible the contact with air of even the portion of the liquid composition which is to be used as the fuel at the relay pump station, and to completely avoid the contact with air of the remainder of the liquid composition that will be continued to be transported through the pipeline.

Figure 3:
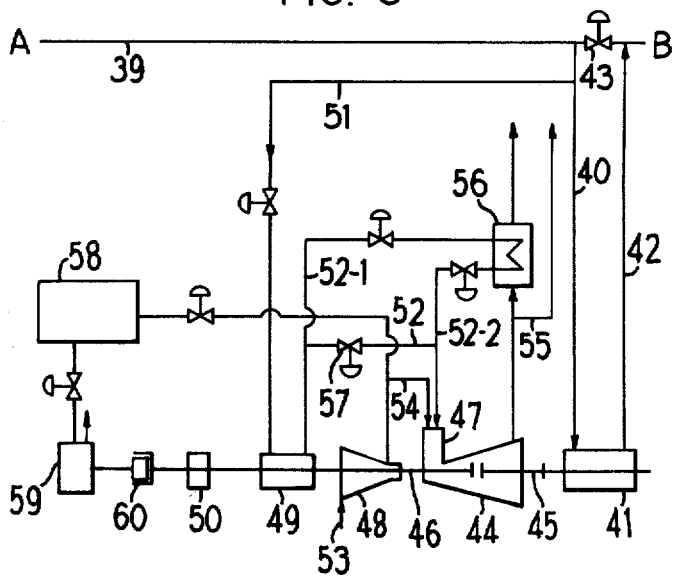
FIG. 3 illustrates an example of an installation at a relay pump station.

FIG. 3 diagrammatically illustrates an installation for elevating again the pressure of the liquid composition at one relay pump station along the pipeline 39. Symbol A represents the site of shipment of the pipeline and B is the destination. This relay pump station is spaced a distance of at least about 50 km from the site of shipment, destination or other relay pump stations nearest thereto. In FIG. 3, reference numeral 41 represents the multi-stage centrifugal pump which draws in the liquid composition pressure-transported in the pipeline 39 through a pipe 40 on the A side of a normally closed valve 43, elevates again its pressure and pressure-feeds it to the B side of the valve 43 of the pipeline 39. The construction of the pump 41 is known and hence need not be described. Generally, the centrifugal pump 41 elevates the pressure of the liquid composition, which is from 1 to 5 kg/cm$^2$ in pipe 40, to 10 to 190 kg/cm$^2$ in pipe 42. This pump 41 must be rotated at a rotational speed of at least 2,000 r.p.m. When operation of the pump 41 is stopped, residual tensile stress exists around the inner circumferential portion of the vane impeller which is shrink-fitted onto the rotary shaft. In addition, strong tensile stress is present over the entire portion of the vane impeller as well as on the casing portion close to the discharge side during the pump operation. Accordingly, if the liquid composition is within the aforementioned pressure-untransportable range, stress corrosion cracking will occur at portions where the tensile stress exists due to corrosion so that the use of a high-speed multi-stage centrifugal pump is hardly possible. In accordance with the present invention, however, the use of the centrifugal pump made of plain carbon steel or low alloy steel is possible.

In FIG. 3, reference numeral 44 represents the gas turbine for driving the multi-stage centrifugal pump 41 and its auxiliary rotatable machines. The gas turbine has two rotary shafts 45 and 46. The rotary shaft 45 is interconnected to the multi-stage centrifugal pump 41 while the rotary shaft 46 is interconnected (1) to a centrifugal compressor 48 (generally, it is a multi-stage centrifugal compressor) for feeding compressed air to the combustion chamber 47 of the gas turbine, (2) to a single or multi-stage centrifugal pump 49 (hereinafter referred to as the "fuel pump") for feeding the liquid composition as the fuel to the combustion chamber 47, and (3) to a lubricant pump 50. The fuel pump 49 draws in and pressurizes a part of the liquid composition, that is being pressure-transported through the pipe 51, from the pipe 40 and feeds it through the pipe 52 to at least one combustion chamber 47 (one chamber being shown in FIG. 3 as a typical of the fuel chambers) disposed in the gas turbine, in accordance with its capacity. The centrifugal compressor 48 draws in air from an air suction port 53 and, after compressing it, feeds it to the combustion chamber 47 for burning the liquid composition. In order for the gas turbine 44 to fully exhibit its function, the pressurized liquid composition, as well as the compressed air to be supplied to the combustion chambers 47, must have a pressure of at least 10 kg/cm$^2$, and generally, from 20 to 50 kg/cm$^2$. The fuel pump 49 and the centrifugal compressor 48 must be operated at a high speed of at least 3,000 r.p.m., because the fuel pump 49 has a smaller pressurized liquid quantity than the multi-stage centrifugal pump 41 and because the centrifugal compressor 48 must centrifugally compress the low-density air.

If the liquid composition is within the aforementioned pressure-untransportable range, stress corrosion cracking develops in the fuel pump 49 in the same way as in the multi-stage centrifugal pump 41, but this can be prevented in accordance with the present invention. The piping system comprising the pipes 40, 42, 51, 52, 52-1, 52-2 and the like for interconnecting the above-mentioned rotary apparatus must be subjected to high temperature assembly operations, such as welding, in order to produce, bend and connect the pipes. The aforementioned residual tensile stress always exists in these piping arrangements and stress corrosion cracking can develop in the same way as in the multi-stage centrifugal pump if the liquid composition is within the pressure-untransportable range. This can also be prevented in accordance with the present invention.

In FIG. 3, reference numeral 56 represents a heater for vaporizing the liquid composition that is pressurized by the fuel pump 49 for use as a fuel. After the gas turbine 44 reaches its normal operating condition, the fuel for this gas turbine is introduced into the heater 56 through the pipe 52-1. A part of the combustion exhaust gas from the gas turbine 44, which gas is still at a high temperature after the gas is expanded and its pressure is reduced in the gas turbine, is used for indirectly heating and vaporizing the liquid composition introduced into the heater 56, without reducing its pressure, in particular so that the saturated vapor or super-heated vapor of the liquid composition is introduced into the combustion chamber 47 through the pipe 52-2.

In accordance with the above-mentioned method of burning the liquid composition after it is converted into high-pressure vapor, the efficiency of the use of the liquid composition as the fuel can be improved and the amount of the fuel for the gas turbine can be reduced. In this case, too, the vaporization pipe inside the heater 56 is kept at a high temperature both inside and outside. If the liquid composition to be vaporized inside this vaporization pipe is within the aforementioned pressure-untransportable range, vigorous stress corrosion cracking and corrosion will occur. However, the method of the present invention prevents these disadvantages and makes possible an efficient use of the liquid composition as the fuel. The method of burning the liquid composition as the fuel for the gas turbine 44 after converting it into the high-pressure vapor can be applied to all the numerous relay pump stations between the site of shipment A and the destination B. Accordingly, this method can reduce the amount of liquid composition used as the fuel due to the increases in the calorific power of the liquid composition resulting from the simultaneous pressure-transport with the aforementioned organic by-products and hydrocarbons and thereby will increase the quantity of the liquid composition that will be received at the destination B, based on the quantity of the liquid composition that is pressure-fed into the site of shipment A. In conjunction with the method of handling the liquid composition at each relay pump station using the above-mentioned installation, the operation at the station can be safely carried out while preventing not only the liquid composition that is to be transported to the next station, but also the liquid composition that is to be used as the fuel for the gas turbine, from coming into contact with air before the latter is fed to the combustion chamber 47 and thereby avoids the increase in the formic acid content that would otherwise be caused by contact of the liquid composition with air in accordance with the aforementioned reactions (3) and (4).

In the gas turbine 44 shown in FIG. 3, it is of importance that the turbine has two rotary shafts 45 and 46 because the rotational speed of the multistage centrifugal pump 41 must be changed so as to adjust the pressure-transport quantity of the liquid composition and disadvantages that would otherwise occur must be prevented because the air compressor 48 and the fuel pump 49 have a different rotational speed from that of the multi-stage centrifugal pump 41.

The method of starting the operation at the relay pump station shown in FIG. 3 will be briefly explained. In FIG. 3, reference numeral 59 represents a prime mover which is a so-called "air motor" that uses compressed air as its energy source. A part of the compressed air prepared in the air compressor 48 is stored, in advance, in a compressed air reservoir 58 during the normal operation of the gas turbine 44 and that compressed air is used for actuating the air motor 59 when the operation of the gas turbine 44 is to be started again, so as to rotate the air compressor 48, the fuel pump 49 and the oil pump 50. The air motor 59 is, therefore, an auxiliary device for feeding the fuel and compressed air having the necessary pressure for starting the gas turbine by applying air and fuel to the combustion chamber 47. After the gas turbine 44 starts operating, the feed of the compressed air to this air motor 59 is terminated and the clutch 60 is disengaged, thereby stopping the rotation of the air motor.

Figure 4:
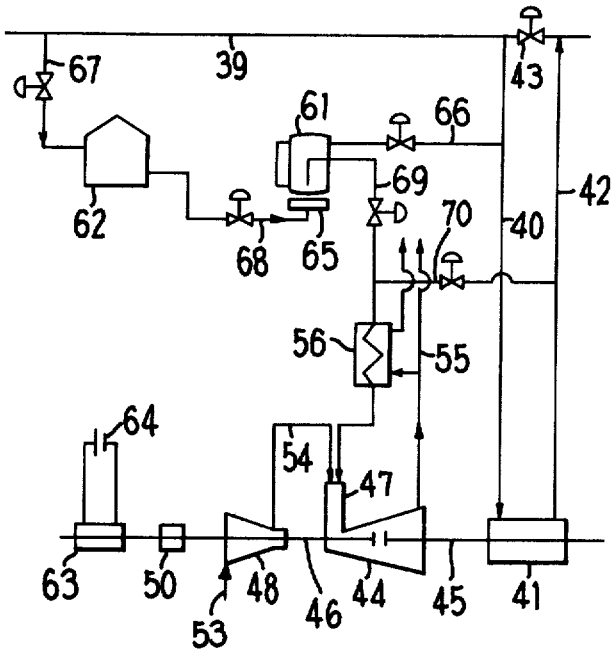
FIG. 4 illustrates another example of an installation at a relay pump station.

The compressed air tank 58, the air motor 59 and the clutch 60 can be replaced by a small generator 63 and a secondary cell 64, such as shown in FIG. 4. A remote control system can be used to start the generator 63 by transmitting a signal of a micro-small current either by wire or by a wireless system from a remote place, such as the site of shipment, the destination or a small number of suitably selected relay pump stations.

FIG. 4 illustrates another embodiment of equipment for use at the relay pump station which is fundamentally different from that shown in FIG. 3 in that the fuel pump 49 for the gas turbine shown in FIG. 3 is not employed. Stress corrosion cracking or corrosion causes problems at some portions of the installation in the same way as in the embodiment of FIG. 3 if the liquid composition is within the pressure-untransportable range. In the embodiment of FIG. 4, a desired quantity of the liquid composition, as the fuel, is stored, in advance, in a pressure-resistant tank 61. The liquid composition is fed into the tank 61 from the pipeline 39 through a pipe 66. Another portion of the liquid composition is also stored in another fuel tank 62 through a pipe 67. Other fuels, such as oils, may be stored in this fuel tank 62. The liquid composition stored in this fuel tank 62 is not again returned to the pipeline 39 even if it is brought into contact with air. All of the tank 62, the pipe 68 and the burner 65 are used at atmospheric pressure. For these reasons, it is extremely unlikely that critical problems will occur due to stress corrosion cracking of these parts.

On the other hand, the motor/generator 63 generates electric power during the normal operation of the gas turbine 44 and the power is stored in the secondary cell 64. When the operation of the gas turbine is to be started, the liquid composition in the fueltank 62 is supplied to the burner 65 through the pipe 68 and is burnt so that the liquid composition inside the pressure-resistant heating tank 61 is heated and its vapor pressure is raised. At the same time, the motor/generator 63 is rotated as a motor by the electric power stored in the secondary cell 64, thereby rotating the air compressor 48 and the lubricant pump 50 so as to produce compressed air and to lubricate necessary portions. After the pressure of the compressed air on the discharge side of the air compressor 48 attains the necessary pressure for starting the gas turbine, the solution or vapor of the liquid composition, whose pressure has been elevated by the vapor pressure inside the pressure-resistant heating tank 61, is supplied to the combustion chamber 47 through the pipe 69 so that the solution or vapor is mixed with air and the mixture is ignited and burnt to start the operation of the gas turbine 44.

After the gas turbine 44 starts operating and the pressure of the liquid composition on the discharge side of the multi-stage centrifugal pump 41 becomes sufficiently large, the feed passage of the liquid composition to be supplied to the combustion chamber 47 is changed over from the pipe 69 to a pipe 70 and heating of the liquid composition inside the pressure-resistant heating tank by the burner 65 is terminated. Also, the generator/motor 63 is changed over to operate as a generator. Thereafter, the quantity of the liquid composition that will be used for the next starting of the operation of the gas turbine 44 is provided by adding the liquid composition to the pressure-resistant heating tank 61 and to the fuel tank 62 through the pipe 66 or 67 to prepare for the next operation of starting the gas turbine. The liquid composition to be supplied to the fuel combustion chamber 47 of the gas turbine 44 through the pipe 70 is preheated by use of a part of the high temperature combustion gas of the gas turbine, which is to be exhausted into the atmosphere, through the heater 56 and the pipe 55 in the same way as in the embodiment shown in FIG. 3. Hence, the liquid composition can be supplied in the form of the pressurized high temperature liquid or vaporized fuel to the combustion chamber 47 and can increase the efficiency of fuel utilization.

If the relation of the content of the formate radical and the water of the liquid composition is within the pressure-untransportable range, in the embodiment shown in FIG. 4, too, corrosion and stress corrosion cracking would occur in the heat-resistant heating tank 61, the heating tube of the heater 56 for the liquid composition and a large number of piping arrangements, especially those which are used at elevated pressure. However, the present invention makes it possible to prevent corrosion and stress corrosion cracking in exactly the same way as in the embodiment shown in FIG. 3.

In either of the embodiments shown in FIGS. 3 and 4, it is possible to use a multi-stage centrifugal pump 41, a gas turbine 44, an air compressor 48, an air motor 59, a generator/motor 63 and a lubricant pump 50 that are produced by the conventional design and production methods. It is known to be important that, in order to reduce the power for compression, the pressurized air, whose temperature has been raised by compression in the air compressor 48, is withdrawn whenever the air pressure reaches a value of 2 to 4 times as high as the initial one, then that heated pressurized air is indirectly cooled by cooling water or by cold air to a temperature near to ambient temperature and then is again compressed by the air compressor. Generally, high-temperature pressurized air discharged from the final compression stage is also cooled, but for the object of the present invention, it is better to feed only the high temperature compressed air discharged from the final compression stage, as it is held at high temperature, to the combustion chamber 47, because the fuel can be used efficiently and the necessary amount of the compressed air can be saved for the same reasons as in the case in which the liquid composition is preheated, vaporized and then supplied to the combustion chamber 47.

Although the present invention has been described with reference to the aforementioned preferred embodiments, it is not limited to them. For example, the embodiment shown in FIG. 2 uses a crude methanol purification method in which a single rectifying column 13 or first and second rectifying columns 13 and 20 are employed to remove formic acid, methyl formate and water from crude methanol so that the relation of the content of the formate radical and the water content in the liquid composition, that is, the methanol or the methanol-containing solution, is adjusted to the pressure-transportable range and a liquid composition falling within the pressure-transportable range and having a reduced water content can be obtained. However, a method using an ion exchange resin may be cited as a method of removing formic acid and methyl formate, instead of the above-mentioned method using the alkali during the rectifying of the crude methanol. Formic acid can be removed by passing the crude methanol through an anion exchange resin at a temperature considerably lower than the upper limit of temperature at which the anion exchange resin can be used. In this case, not only formic acid contained in the solution but also formic acid formed by the hydrolysis of methyl formate, in accordance with the aforementioned reaction (4), are adsorbed and removed by the ion exchange resin. Hence, the reaction rapidly proceeds if the water content is at least 5% and the methyl formate content can also be reduced to an extent which satisfies the object of the present invention. The method of removing formic acid and methyl formate from crude methanol by means of ion exchange makes possible the production of a liquid composition falling within the pressure-transportable range from crude methanol without employing a rectifying method, such as the one shown in the embodiment of FIG. 2 and is, therefore, a preferred method for treating crude methanol having a small water content and produced from a starting gas having a small carbon dioxide content.

However, if a liquid composition having at least 5% of the water is pressure-transported through an extremely long pipeline, various disadvantages would occur, such as the necessity of using a pipeline having a greater diameter for the pressure-transport of the same quantity of the energy-supplying contents in the liquid composition, an increase in the necessary power for raising the pressure at the relay pump stations, an increase in the quantity of consumption of the necessary liquid composition used as the fuel for generating the same power to compensate for the drop in the calorific power of the liquid composition, and so forth. If the pipeline is extremely long, therefore, it is more advantageous to pressure-transport the liquid composition through the pipeline in the form of a dehydrated liquid composition having a water content of up to 1%. In this case, too, if formic acid and methyl formate in the crude methanol are removed in advance in accordance with the above-mentioned ion exchange method, the recovery and reuse of the organic by-products which have higher boiling points than that of water, especially those which do not form an azeotropic mixture with water having a lower boiling point than that of water become easier, without adding the alkali, according to the method using the rectifying column or columns such as in the embodiment shown in FIG. 2.

There are also a large number of embodiments for elevating the pressure of the liquid composition by the use of the gas turbine using the liquid composition that is being pressure-transported, as the fuel at the relay pump station, including the method of starting the operation of the gas turbine. For example, it is possible to use the generator/motor 63 shown in FIG. 4 in place of the air motor 59 in order to actuate the air compressor 48 and the multi-stage centrifugal pump 49 in the embodiment shown in FIG. 3. It is also possible to use the air motor 59 in place of the generator/motor 63 shown in FIG. 4.

In accordance with the method of the present invention, as described above in detail, it is now possible safely to use plain carbon steel and low alloy steel, the sum of whose metallic components other than iron is up to 5 wt. %, for the principal structural components of the pipeline installation that contact the liquid composition, such as the pipeline 39, the multi-stage centrifugal pump 41, the fuel pump 49, the heating pipe inside the heater 56 and piping arrangements other than the specific portions, such as the combustion chamber 47 of the gas turbine and the vane impeller of the gas turbine, without causing stress corrosion cracking and ordinary corrosion on these structural members. If the method of the present invention is not employed, on the contrary, it becomes necessary to use a highly corrosion-resistant, expensive metal, such as stainless steel, for the above-mentioned principal structural members and the cost of the installation becomes remarkably high. Since the present invention clarifies that the liquid composition can be pressure-transported so long as the content of the formate radical and that of the water are within the pressure-transportable range, it is now possible to carry out the pressure-transport without removing the organic by-products from the methanol-containing solution. Since the organic by-products are present in the methanol-containing solution, the hydrocarbons are dissolved and can be simultaneously pressure-transported even if a small amount of water is also contained in the methanol-containing solution. The presence of a small amount of formates is permitted within the pressure-transportable range and, in this case, the presence of a small amount of water is preferable so that the energy necessary for purifying the crude methanol can be saved. Taken altogether, these advantages improve the efficiency of energy utilization in the production of crude methanol and help to save the energy necessary for purifying crude methanol and for the pressure-transport thereof through a pipeline.

[Example] Stress Corrosion Cracking Test

Figure 5:
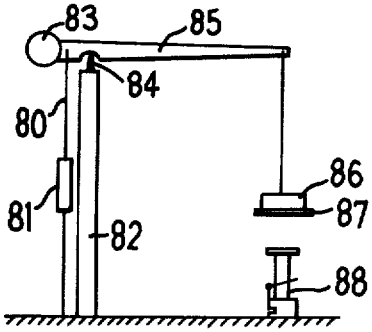
FIG. 5 diagrammatically illustrates the testing apparatus for the stress corrosion cracking test.
Figure 6:
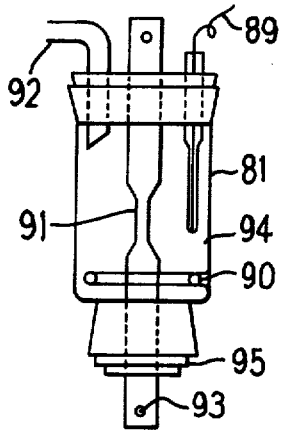
FIG. 6 is an enlarged view of a fragment of FIG. 5.

A stress corrosion cracking test was conducted in order to examine the susceptibility of carbon steel to stress corrosion cracking in methanol containing a small amount of formic acid and to establish the method of preventing stress corrosion cracking. As shown in FIG. 5, the tester used for the test was a vertical lever load type apparatus having a load capacity of 1 ton, a lever ratio of 1:10 and a load accuracy of ±0.5%. In FIG. 5, reference numeral 82 represents a support post and reference numeral 84 represents a knife edge fitted on the support post 82. Reference numeral 85 represents a lever placed on the knife edge 84. The lever 85 is equipped at one of its ends with a weight 83 and a connecting rod 80 for transmitting a load to the testpiece and at the other end with a dead load 86 suspended and placed on a receiving tray 87 for the dead load. Reference numeral 81 represents a corroding solution tank. FIG. 6 is an enlarged view of the tank 81. The testpiece 91 was immersed in methanol held at a desired temperature inside this corroding solution tank 81 and both the upper and lower ends of the testpiece were connected to the connecting rod 80 by bolts. The lower connecting rod is fixed to the floor so that the gravitational force acting on the dead load 86 from the upper connecting rod effects reinforcing and inversion of direction in accordance with the lever principle and acts as a tensile load on the testpiece.

In carrying out a test extremely sensitive to stress, such as the stress corrosion cracking test, involving stress distribution within the testpiece, the occurrence of shearing force and impact load at the time of application of load must be avoided. In the tester used for the above-mentioned test, the chuck portion of the connecting rod 80 is improved so that only static tensile stress occurs, and an oil jack 88 is disposed below the dead load receiving tray 87 so as to avoid impact at the time of application of the load, and the oil jack 88 is gradually and slowly moved up and down so as to mitigate the application of the dead load.

FIG. 6 is an enlarged view of the corroding solution tank 81 equipped with a rubber lower lid 95 through which the testpiece 91 penetrates in intimate contact therewith at its lower part, a rubber upper lid through which the testpiece 91 penetrates with a slight gap between them at its upper part and an inner space 94 into which the corroding solution is fully charged. The corroding solution is adjusted to a desired temperature by an annular heater 90 and the liquid temperature is measured by a thermocouple 89. The space above the liquid level inside the corroding solution tank 81 is completely filled with nitrogen gas fed from a vinyl pipe connection port 92. Holes 93 close to the upper and lower ends of the testpiece 91 are bolt holes for connecting the testpiece to the connecting rods 80.

The testpiece 91 had an overall length of 500 mm, a length of 50 mm at its intermediate portion and a width of 10 mm. It was produced by machining a 2 mm-thick sheet material according to JIS SS41. Before the stress corrosion cracking test, the tensile test of the testpiece was carried out at ambient temperature in the atmosphere. It was found that tensile strength was 44 $kg/mm^2$ and the yield point was 34 $kg/mm^2$.

Figure 7:
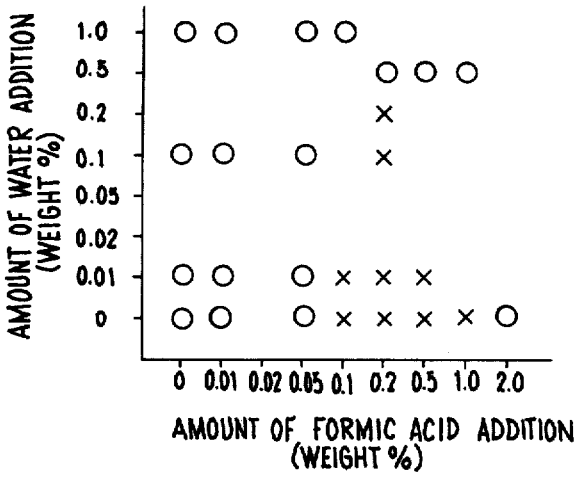
FIG. 7 is a diagram showing the results of the first test described hereinafter.

The first test was conducted using the apparatus shown and the testpiece shown in FIGS. 5 and 6. In the first test, the stress test under corrosion was carried out for 100 hours by dipping the testpiece in each of a large number of corroding solutions having different combinations of contents of formic acid and water, prepared by adding 0.01 to 2% formic acid and 0.01 to 1% water to reagent grade methanol at 60° C., while applying tensile stress equal to 80% of the yield value of the above-mentioned measurement as a static tensile stress to the testpiece. .After the test, the testpiece was withdrawn from the corroding solution tank and confirmation of the occurrence of stress corrosion cracking and observation of ordinary cracking by the naked eye were conducted through dye permeation flaw detection and microscopic observation of the section of the testpiece. The principal portions of these test results are illustrated in FIG. 7. In the drawing, O represents that no occurrence of stress corrosion cracking was observed with the amounts of addition of formic acid and water corresponding to the position of the mark O and, in contrast, X represents that stress corrosion cracking was observed. Although not shown in FIG. 7, no stress corrosion cracking was observed by varying the amounts of addition of water if the amount of formic acid was from 2 to 3% but occurrences of mild rusting were observed at the liquid contact portion of the testpiece. This rust became remarkable when the amount of addition of formic acid was more than 3%. As is obvious from these test results, stress corrosion cracking occurred clearly if the amounts of addition of formic acid and water were from 0.1 to 1.0% and from 0 to 0.2%, respectively.

Figure 8:
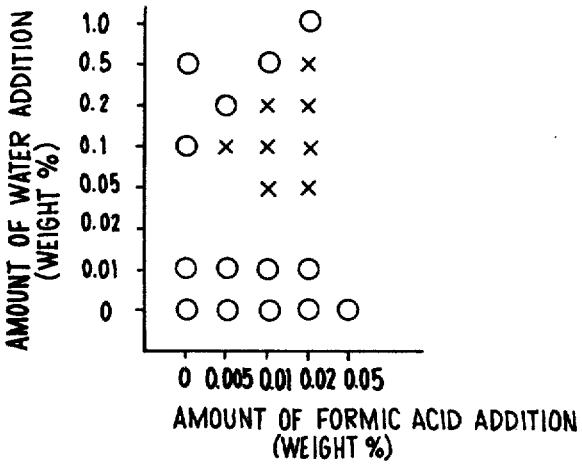
FIG. 8 is a diagram showing the results of the second test described hereinafter.
Figure 9A:
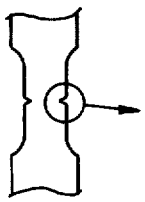
FIGS. 9*a* and 9*b* are an enlarged view of the slit of the testpiece used in the second test.
Figure 9B:
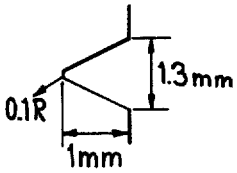

Next, as the second test, a test similar to the first test was conducted under stress concentration when the amount of addition of formic acid was below 0.1%. The testpiece used in this second test was prepared by forming a slit, shown in an enlarged view of FIG. 9(*b*) at the center of the parallel portion of the testpiece analogous to the one used in the first test, shown in FIG. 9(*a*), so that stress concentrated at this slit. The method of observation of the testpiece after the test was the same as that of the first test. The results of this test are illustrated in FIG. 8, in which the symbols have the same meaning as in FIG. 7. As is obvious from FIG. 8, stress corrosion cracking occurred in the range of the amount of addition of formic acid of from 0.005 to 0.05% in the presence of stress concentration, and stress corrosion cracking occurred at the portion at which the stress was concentrated, even in the case of conventional industrial grade purified methanol. It could be assumed from both FIGS. 7 and 8 that addition of water in an amount greater than 0.2% had a restricting action against stress corrosion cracking caused by formic acid.

The embodiments of the invention in which an exclusive property or privilege is claimed are defined as follows:

1. In a method for the long-distance pressure transport of a liquid comprised primarily of methanol and optionally containing water, formic acid and one or more organic compounds through a pipeline installation wherein the portions of said pipeline installation in contact with said liquid consist principally of low carbon steel and/or low alloy steel the sum of whose metallic components other than Fe is up to 5 wt. %, the improvement which comprises: the water content of said liquid is limited (1) to the range of 0 to 35 wt. % if the content of formate radicals in said liquid is up to 0.05 wt. %, (2) to the range of 0.25 to 35 wt. % if the content of formate radicals in said liquid is in the range of 0.05 to 2 wt. %, and (3) to the range of 0 to 35 wt. % if the content of the formate radicals in said liquid is in the range of 2 to 3 wt. %, so that said liquid is pressure-transported while the volume ratio of the formate radicals to the water content is maintained at a ratio that does not permit the presence of more than 3 wt. % of formate radicals in said liquid.

2. The method as defined in claim 1 in which the pressure of the liquid is elevated by one or more multi-stage centrifugal pumps during the pipeline pressure transport, and each of said multi-stage centrifugal pumps is driven by a gas turbine using a part of said liquid, which is being pressure-transported, as the fuel.

3. The method as defined in claim 1 in which said liquid consists essentially of methanol, water, formic acid and one or more organic compounds selected from the group consisting of (1) organic by-products of the reaction of hydrogen with carbon monoxide and carbon dioxide to produce methanol, and (2) alkanes having 1 to 4 carbon atoms, said liquid containing up to 0.1 wt. % of formate radicals and from 0.25 to 5 wt. % of water, the amount of said organic compounds being up to their saturation concentration in the methanol.

4. The method as claimed in claim 3 in which said liquid contains from 0.05 to 0.1 wt. % of formate radicals and from 0.25 to 0.5 wt. % of water.

5. The method as defined in claim 1 in which said liquid consists essentially of up to 0.05 wt. % of formic acid, up to 0.1 wt. % of water and the balance is methanol.

6. The method as defined in claim 1 in which said liquid consists essentially of 0.05 to 0.5 wt. % of formate radicals, from 4 to 20 wt. % of water, up to 15 wt. % of said organic by-products, up to the saturation concentration of said alkanes in said methanol, and the balance is said methanol.

* * * * *